US011442375B2

(12) United States Patent
Minamoto

(10) Patent No.: US 11,442,375 B2
(45) Date of Patent: Sep. 13, 2022

(54) IMAGE FORMING APPARATUS INCLUDING DETACHABLE DRUM UNIT AND DEVELOPMENT UNIT

(71) Applicant: KYOCERA Document Solutions Inc., Osaka (JP)

(72) Inventor: Riku Minamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/410,773

(22) Filed: Aug. 24, 2021

(65) Prior Publication Data

US 2022/0066352 A1 Mar. 3, 2022

(30) Foreign Application Priority Data

Aug. 26, 2020 (JP) ..... JP2020-142866

(51) Int. Cl.

| | |
|---|---|
| ***G03G 15/00*** | (2006.01) |
| ***G03G 21/16*** | (2006.01) |
| ***G03G 21/18*** | (2006.01) |
| ***G03G 15/08*** | (2006.01) |

(52) U.S. Cl.

CPC ..... *G03G 15/0808* (2013.01); *G03G 21/1647* (2013.01); *G03G 21/1821* (2013.01); *G03G 2221/1651* (2013.01)

(58) Field of Classification Search

CPC ..... G03G 15/0808; G03G 21/1647; G03G 21/1821; G03G 2221/1651; G03G 2221/1853

See application file for complete search history.

(56) References Cited

U.S. PATENT DOCUMENTS

| | | | | |
|---|---|---|---|---|
| 5,089,849 A * | 2/1992 | Hiraoka | ..... | G03G 21/1821 399/119 |
| 10,345,733 B2 | 7/2019 | Kusukawa | | |
| 2019/0011851 A1* | 1/2019 | Iriyama | ..... | G03G 15/0808 |

FOREIGN PATENT DOCUMENTS

JP 2018-155777 A 10/2018

* cited by examiner

*Primary Examiner* — Sophia S Chen

(74) *Attorney, Agent, or Firm* — Studebaker & Brackett PC

(57) ABSTRACT

An image forming apparatus includes a drum unit, a development unit, a supporting part, and a biasing part. The supporting part supports the development unit so as to be shiftable in directions close to and separate from the drum unit. The biasing part biases a development housing of the development unit toward the drum unit. The drum unit is attachable to and detachable from a main housing. When the drum unit is not attached to the main housing, the development unit is biased by the biasing part and is positioned closer to the drum unit than a predetermined position of the development unit when the drum unit is attached. When the drum unit is attached to the main housing, a drum frame of the drum unit pushes away the development housing against a biasing force of the biasing part to shift the development unit to the predetermined position.

7 Claims, 7 Drawing Sheets

IMAGE FORMING APPARATUS INCLUDING DETACHABLE DRUM UNIT AND DEVELOPMENT UNIT

INCORPORATION BY REFERENCE

This application is based on and claims the benefit of priority from Japanese patent application No. 2020-142866 filed on Aug. 26, 2020, which is incorporated by reference in its entirety.

BACKGROUND

The present disclosure relates to an electrophotographic type image forming apparatus.

An electrophotographic type image forming apparatus is provided with a photosensitive drum on which an electrostatic latent image is formed and a development device which supplies a toner to the photosensitive drum to develop the electrostatic latent image. The development device includes a development roller which carries the toner and faces the photosensitive drum, and a bias voltage is applied to the development roller to generate an electric filed by which the toner is supplied to the photosensitive drum. In such a configuration, in order to obtain a predetermined image quality, it is necessary to position the development roller and the photosensitive drum so that a distance between the development roller and the photosensitive drum is as designed. However, in a manner where the photosensitive drum and the development roller are fixed to a main housing, a dimension accuracy and an assembling accuracy have a large influence. Then, conventionally, a technique for positioning the development roller is discussed. For example, an image forming apparatus is proposed, which includes a development roller and a pressing member. The development roller includes a sleeve facing a photosensitive drum with an interval and a roller disposed coaxially with the sleeve and coming into contact with the photosensitive drum. The pressing member biases the rotatably supported development device to press the roller on the photosensitive drum.

However, in the above configuration, in a case where the photosensitive drum is not attached, because the development device is pushed out closer to the photosensitive drum than a predetermined position of the development device when the photosensitive drum is attached, the development device may interfere with the photosensitive drum when the photosensitive drum is attached. If the development device may be pushed back, it becomes possible to form a space in which the photosensitive drum is attached, however, the operator has to hold the photosensitive drum with his both hands for safety, and he cannot push back the development device.

SUMMARY

In accordance with an aspect of the present disclosure, an image forming apparatus includes a drum unit, a development unit, a supporting part, and a biasing part. The drum unit is attachable to and detachable from a main housing, and includes a photosensitive drum on which an electrostatic latent image is formed and a drum frame which supports the photosensitive drum. The development unit includes a development roller which carries a toner and a development housing which supports the development roller. The supporting part supports the development unit so as to be shiftable in directions close to and separate from the drum unit. The biasing part biases the development housing toward the drum unit. The drum unit is attachable to and detachable from the main housing in an attachment direction crossing to a shift direction of the development direction and crossing to an axial direction of the development roller. When the drum unit is not attached to the main housing, the development unit is biased by the biasing part and is positioned closer to the drum unit than a predetermined position of the development unit when the drum unit is attached. When the drum unit is attached to the main housing, the drum frame pushes away the development housing against a biasing force of the biasing part to shift the development unit to the predetermined position.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
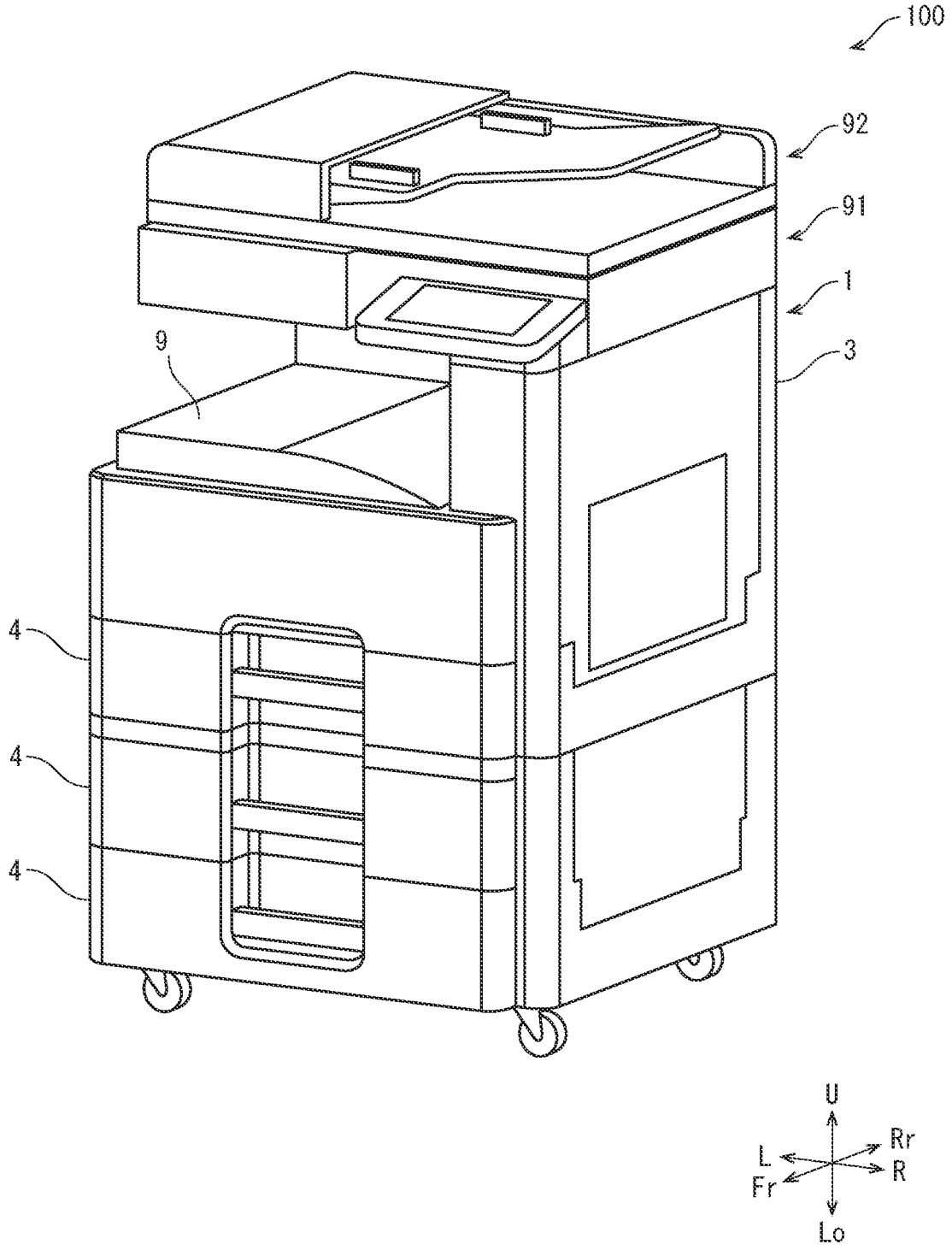
FIG. 1 is a perspective view showing an exterior appearance of a multifunctional peripheral according to one embodiment of the present disclosure.

Hereinafter, with reference to the attached drawings, a multifunctional peripheral 100 according to one embodiment of the present disclosure will be described. The multifunctional peripheral 100 includes a printer 1 (an example of an image forming apparatus), an image reading device 91 and a document conveyance device 92. The printer 1 includes an image forming device 6 and a fixing device 7.

Figure 2:
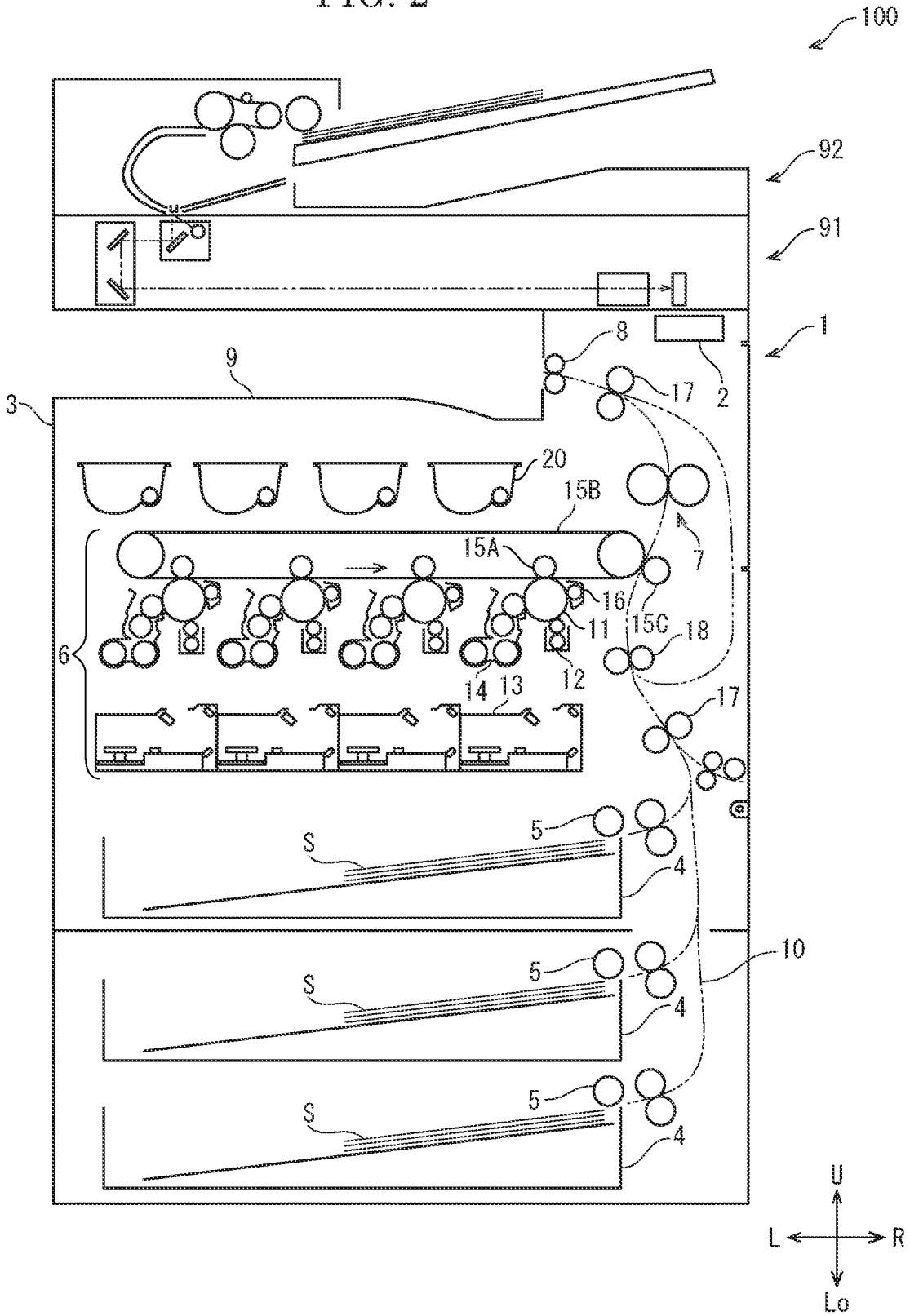
FIG. 2 is a front view schematically showing an inner structure of the multifunctional peripheral according to the embodiment of the present disclosure.

First, an entire structure of the printer 1 will be described. FIG. 1 is a perspective view showing an exterior appearance of the multifunctional peripheral 100. FIG. 2 is a front view schematically showing an inner structure of the multifunctional peripheral 100. In the following description, a front side of the paper plane on which FIG. 2 is drawn is defined as a front side of the multifunctional peripheral 100, and the left-and-right direction is described based on a direction in which the multifunctional peripheral 100 is viewed from the front side. In each figure, U, Lo, L, R, Fr and Rr indicate an upper, a lower, a left, a right, a front and a rear.

The printer 1 includes a parallelepiped shaped main housing 3. In the lower portion of the inside of the main housing 3, sheet feeding cassettes 4 in which a sheet S is stored and sheet feeding rollers 5 which feeds the sheet S from the sheet feeding cassettes 4 are provided. Above the sheet feeding cassettes 4, the image forming device 6 which forms a toner image in an electrophotographic manner and the fixing device 7 which fixes the toner image to the sheet S are provided. In the upper portion of the inside of the main housing 3, a pair of discharge rollers 8 which discharges the sheet S on which the toner image is fixed and a discharge tray 9 on which the discharged sheet S is stacked are provided.

The image forming device 6 includes a photosensitive drum 11 whose potential is changed by irradiation of light, a charger 12 which charges the photosensitive drum 11 by electric discharging, an exposure device 13 which emits laser light according to image data, a development unit 14 which supplies the toner to the photosensitive drum 11, a primary transfer roller 15A which generates a transfer bias, an intermediate transfer belt 15B to which the toner image on the photosensitive drum 11 is transferred, a secondary transfer roller 15C which generates a transfer bias, and a cleaning device 16 which removes the toner remaining on the photosensitive drum 11. A toner container 20 which supplies the toner to the development unit 14 is connected to the development unit 14.

Inside the main housing 3, a conveyance path 10 is provided from the sheet feeding rollers 5 to the pair of discharge rollers 8 via the image forming device 6 and the fixing device 7. On the conveyance path 10, a plurality of conveyance roller pairs 17 which conveys the sheet S is provided. A pair of registration rollers 18 is provided on the upstream side of the image forming device 6 in the conveyance direction.

Each part of the printer 1 is controlled by a controller 2. The controller 2 includes a processor and a memory. The processor is, for example, a CPU (central processing unit). The memory includes a storage medium such as ROM (Read Only Memory), RAM (Random Access Memory), EEPROM (Electrically Erasable Programmable Read Only Memory). The processor performs various processes by reading and executing a control program stored in the memory. The controller 2 may be implemented by an integrated circuit that does not use software.

Next, an outline of an image forming operation of the printer 1 will be described. When a print job is input to the printer 1 from an external computer or the like, the sheet feeding roller 5 feeds the sheet S from the sheet feeding cassette 4 to the conveyance path 10, the registration rollers pair 18 whose rotation is stopped corrects a skew of the sheet S, and then the registration roller pair 18 feeds the sheet S to the image forming device 6 at a predetermined timing. In the image forming device 6, the charger 12 charges the photosensitive drum 11 to a predetermined potential, the exposure device 13 writes an electrostatic latent image on the photosensitive drum 11, the development unit 14 develops the electrostatic latent image with the toner supplied from the toner container 20 into the toner image, the primary transfer roller 15A transfers the toner image to the intermediate transfer belt 15B, and the secondary transfer roller transfers the toner image to the sheet S. Subsequently, the fixing unit 7 fuses the toner image while holding and conveying the sheet S to fix the toner image to the sheet S, and the pair of discharge rollers 8 discharges the sheet S to the discharge tray 9. The cleaning device 16 removes the toner remaining on the photosensitive drum 11.

Figure 3:
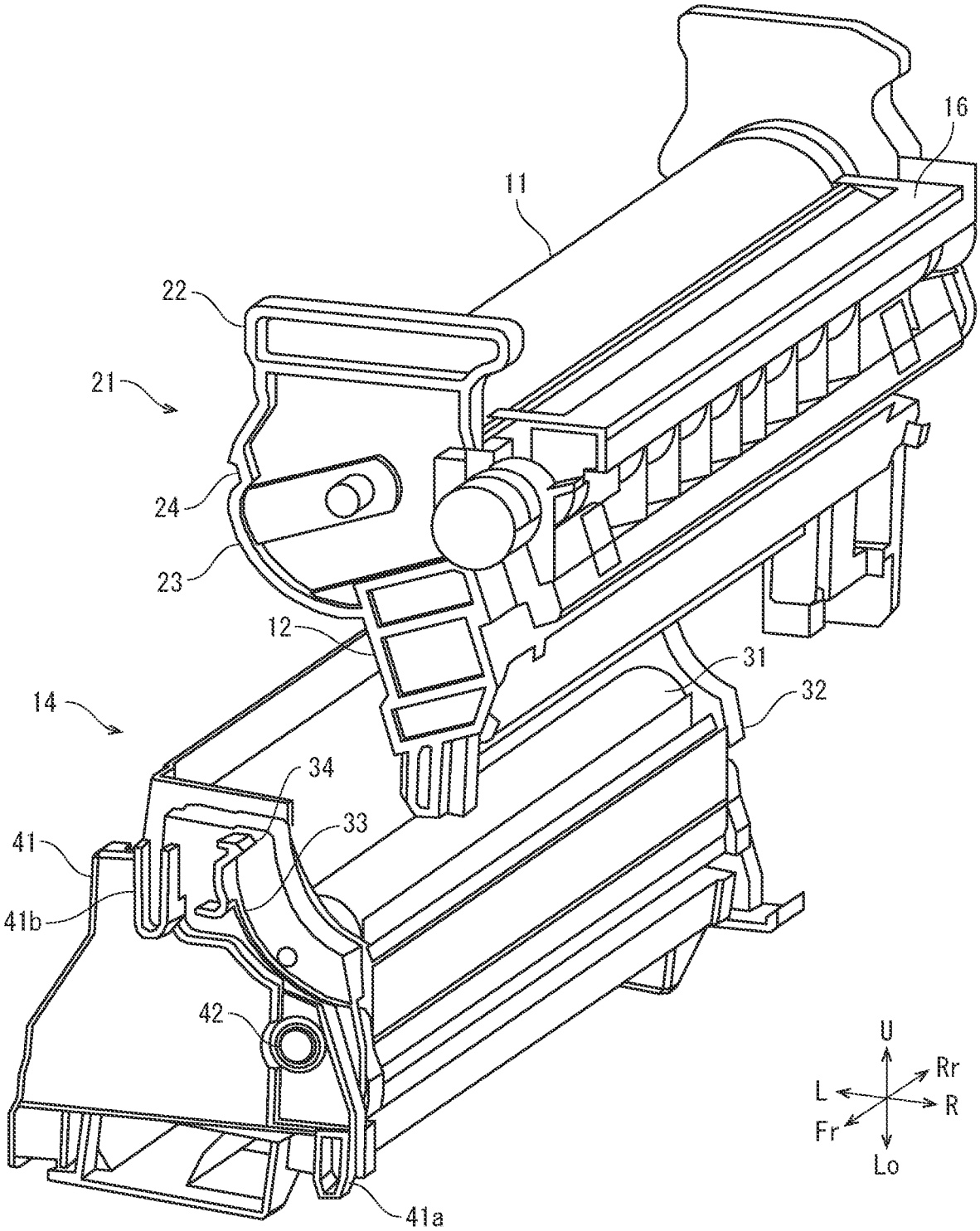
FIG. 3 is a perspective view showing a drum unit and a development unit according to the embodiment of the present disclosure.
Figure 4A:
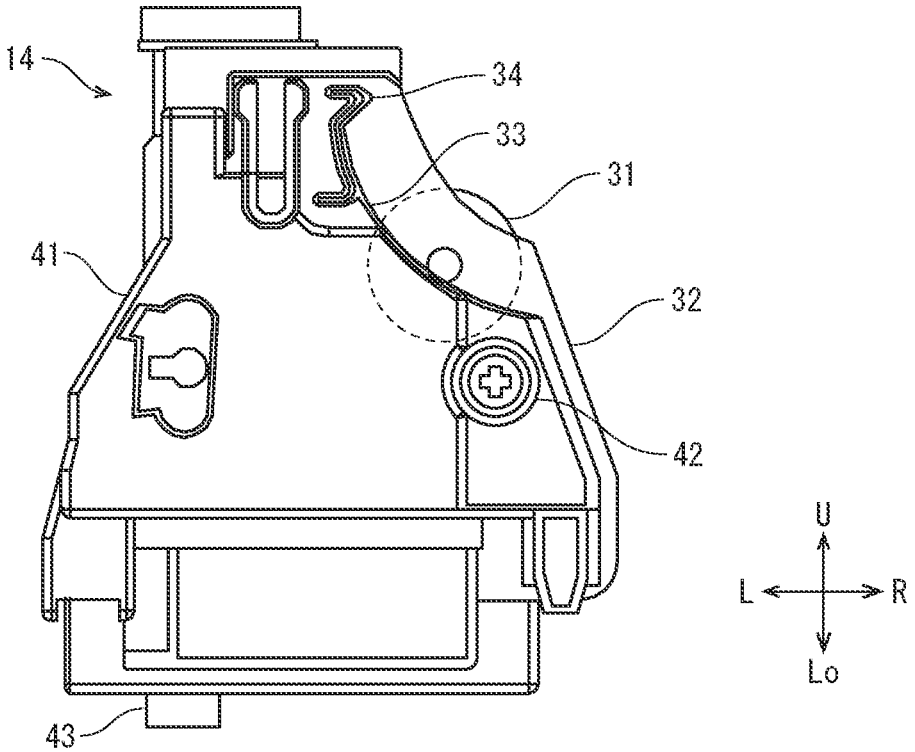
FIG. 4A is a front view showing the development unit positioned at a predetermined position, according to the embodiment of the present disclosure.
Figure 4B:
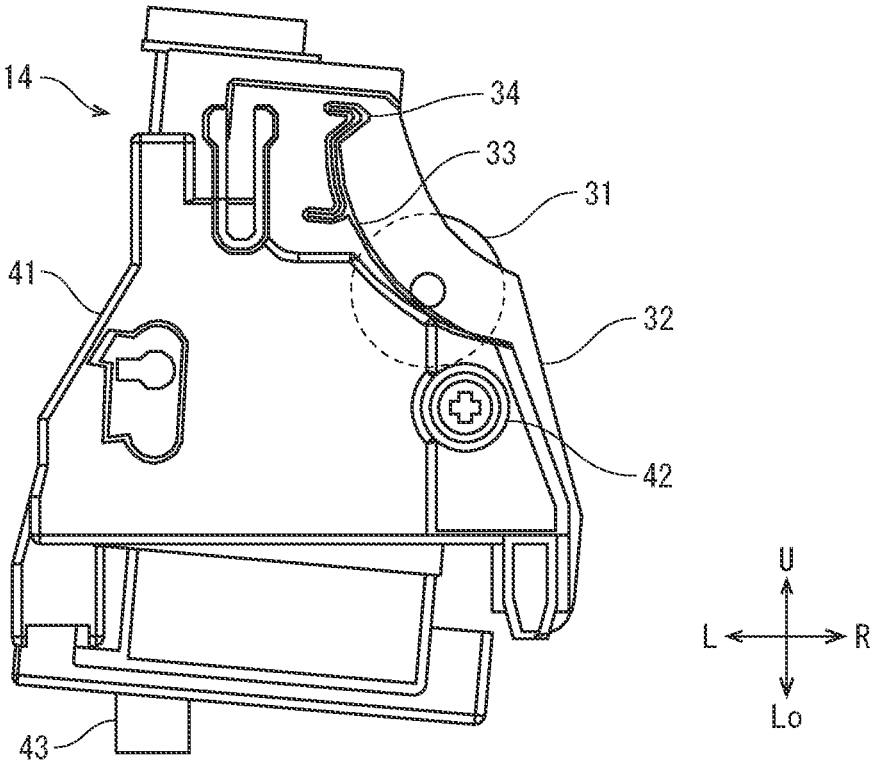
FIG. 4B is a from view showing the development unit positioned closer to the drum unit than the predetermined position, according to the embodiment of the present disclosure.
Figure 5:
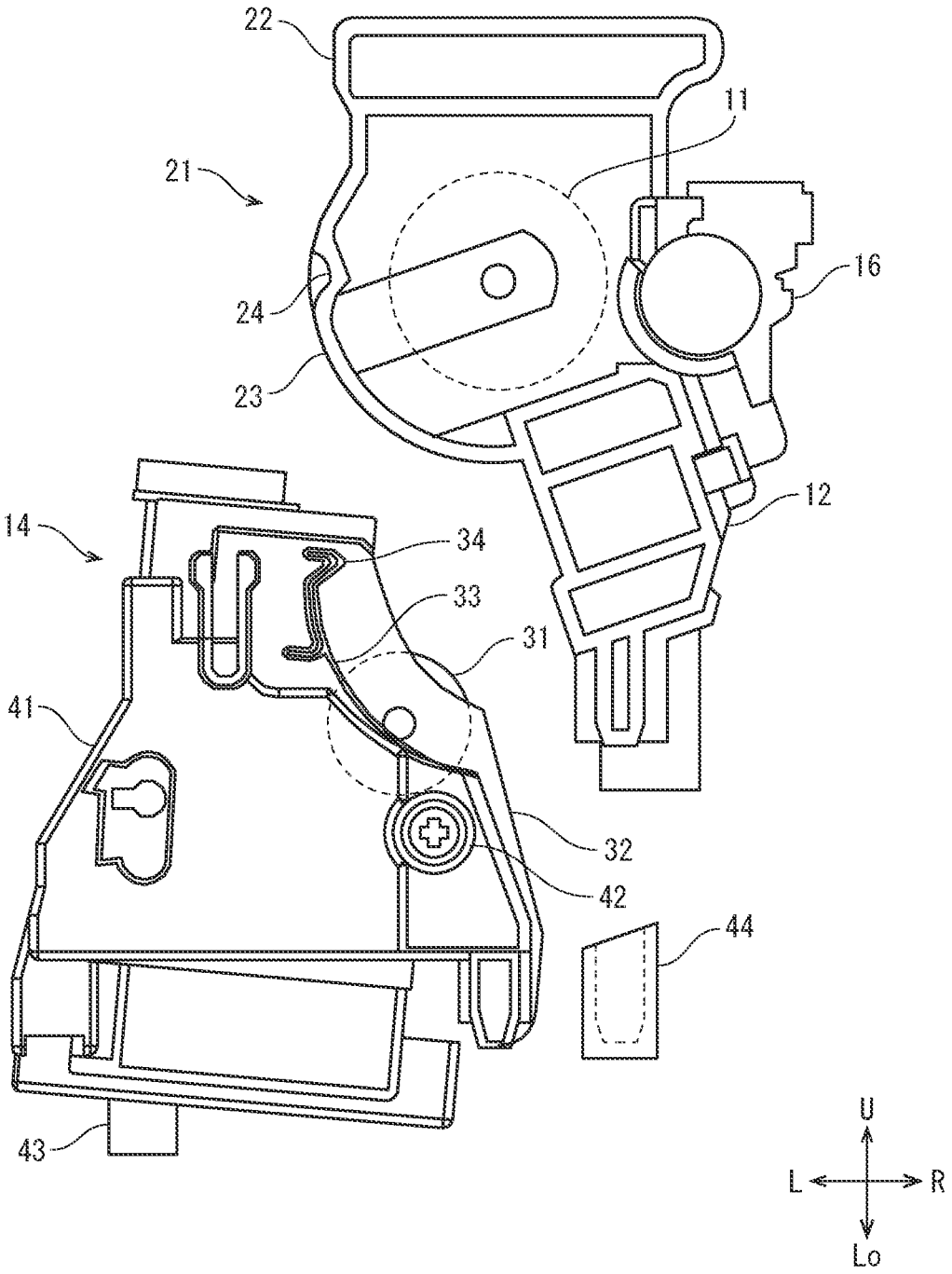
FIG. 5 is a front view showing the drum unit and the development unit before the drum unit is attached.

Next, a drum unit 21 and the development unit 14 will be described in detail. FIG. 3 is a perspective view showing the drum unit 21 and the development unit 14. FIG. 4A is a front view showing the development unit 14 positioned at a predetermined position. FIG. 4B is a front view showing the development unit 14 positioned closer to the drum unit 21 than the predetermined position. FIG. 5 is a front view showing the drum unit 21 the development unit 14 before the drum unit 21 is attached.

The printer 1 includes the drum unit 21, the development unit 14 and a biasing part 43. The drum unit 21 is provided in an attachable and detachable manner, and includes the photosensitive drum 11 and a drum frame 22 which supports the photosensitive drum 11. The development unit 14 includes a development roller 31 which carries the toner and a development housing 32 which supports the development roller 31, and the development housing 32 is supported so as to be shifted in directions close to and separate from the drum unit 21. The biasing part 43 biases the development housing 32 toward the drum frame 22. The drum unit 21 is detachable and attachable in a predetermined attachment direction crossing to the shift direction of the development housing 32 and crossing to an axial direction of the development roller 31. When the drum unit 21 is not attached, the development unit 14 is positioned closer to the drum unit 21 than a predetermined position of the development unit 14 when the drum unit 21 is attached. When the drum unit 21 is attached, the drum frame 22 is moved in the attachment direction and pushes away the development housing 32 against the biasing of the biasing part 43 to shift the development unit 14 to the predetermined position. The detail will be described in below.

[Drum Unit] The drum unit 21 (see FIG. 3 and FIG. 5) is formed by uniting the photosensitive drum 11, the charger 12 and the cleaning device 16 by the drum frame 22. The drum frame 22 has curved surface parts 23 protruding toward the development unit 14 on both outer sides in the axial direction than both the axial end portions of the photosensitive drum 11. The curved surface part 23 is formed in an arc shape having a diameter larger than that of the photosensitive drum 11. The curved surface part 23 has a fitting portion 24 to be fitted to a fitting portion 34 of the development unit 14 to be described later. The fitting portion 24 is formed in a concave shape recessed toward the photosensitive drum 11 when viewed from the axial direction. The fitting portion 24 is formed in a concave shape tapered toward the photosensitive drum 11 when viewed from the axial direction.

[Development Unit] The development unit 14 includes a developer, a screw (not shown) which agitates the developer, the development roller 31 which carries the developer, and the development housing 32 which stores the developer, the screw and the development roller 31. The developer contains the toner and a magnetic carrier. The development roller 31 includes a rotating sleeve, and a magnet is provided inside the sleeve (not shown). The development roller 31 attracts the developer by magnetic force, and forms a magnetic brush on the surface of the sleeve. A part of the development roller 31 is exposed from the development housing 32. The development housing 32 has opposing parts 33 facing the curved surface parts 23 of the drum frame 22. The opposing part 33 is formed in an arc shape corresponding to the curved surface part 23.

The opposing part 33 has the fitting portion 34 to be fitted to the fitting portion 24 of the above drum unit 21. The fitting portion 34 is formed in a convex shape protruding toward the photosensitive drum 11 when viewed from the axial direction. The fitting portion 34 is formed in a convex shape tapered toward the photosensitive drum 11 when viewed from the axial direction. The fitting portion 24 and the fitting portion 34 are fitted to each other when the development unit 14 is shifted to the predetermined position by attachment of the drum unit 21.

[Supporting Part and Biasing Part] A supporting part 41 faces both the front and rear end portions of the development housing 32, and supports the development housing 32 in a turnable manner around a turning shaft 42 provided below the development roller 31. The supporting part 41 is coupled to the development housing 32 by the turning shaft 42, and is integrated with the development unit 14. The development unit 14 is attachable to and detachable from the main housing 3 in the upper-and-lower direction. Specifically, the supporting part 41 has fixed portions 41*a* and 41*b* protruding outward in the axial direction, and the main housing 3 has recessed fixing portions (not shown) corresponding to the fixed portions 41*a* and 41*b*. When the fixed portions 41*a* and 41*b* are inserted into the fixed portions from above, the supporting part 41 is fixed to the main housing 3.

The biasing part 43 is, for example, a coil spring, and is disposed between the development housing 32 and the main housing 3. The biasing part 43 is provided in the main housing 3, and biases the development housing 32 toward the drum frame 22. The biasing part 43 may be provided in the development unit 14. FIG. 4A shows the development unit 14 positioned at the predetermined position when the drum unit 21 is attached. On the other hand, FIG. 4B shows the development unit 14 positioned closer to the drum unit 21 than the predetermined position.

[Guide Part] A guide part 44 faces both the front end rear end portions of the drum frame 22, and is fixed to the main housing 3. The guide part 44 has a recess whose upper face is opened, and the lower end portion of the drum frame 22 is stored in the recess. By lowering the drum frame 22 along the guide part 44, the drum unit 21 is attached. When the lower end portion of the drum frame 22 comes into contact with the bottom face of the recess of the guide part 44, the drum unit 21 is positioned.

Figure 6:
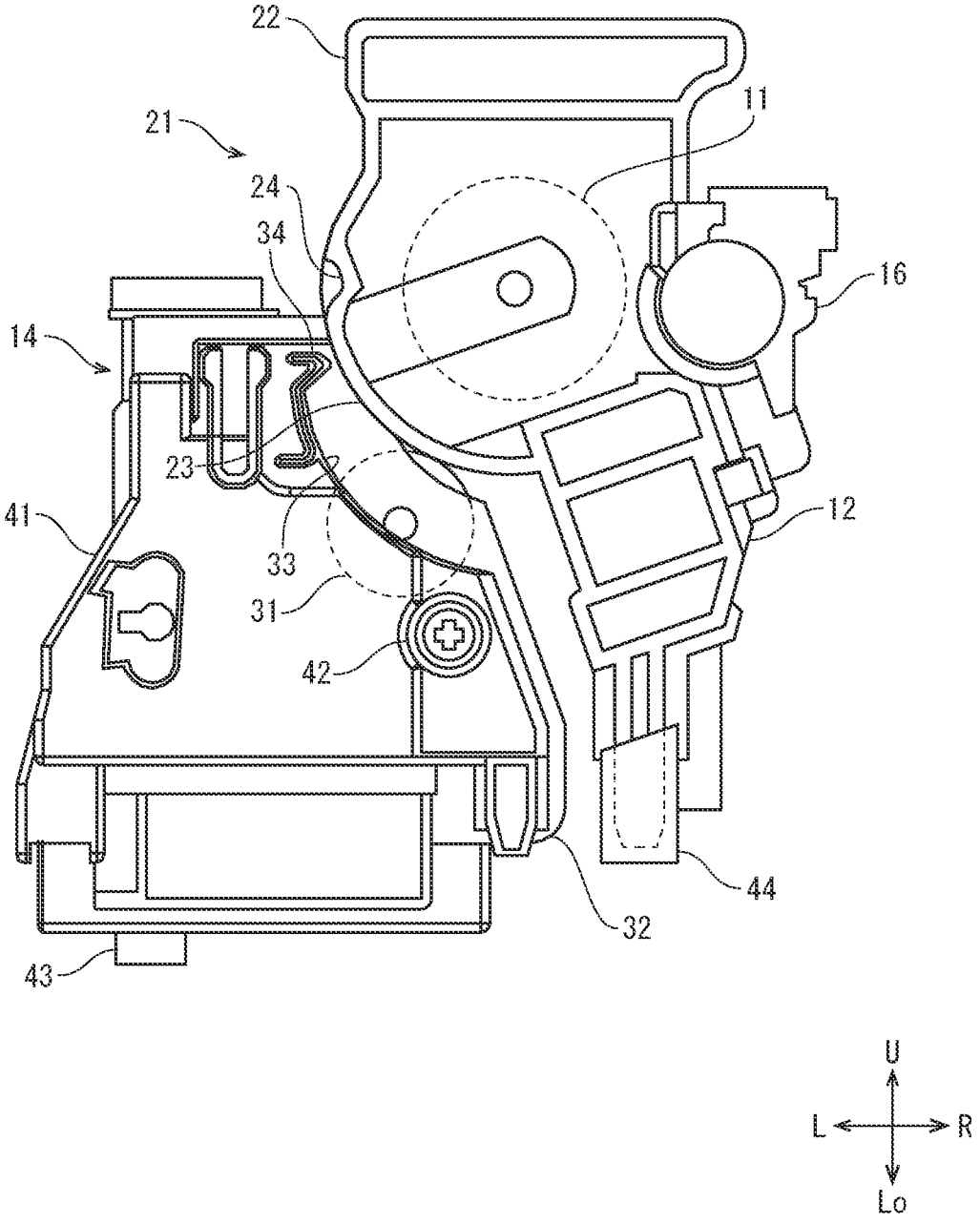
FIG. 6 is a front view showing the development unit pushed away by the drum unit.
Figure 7:
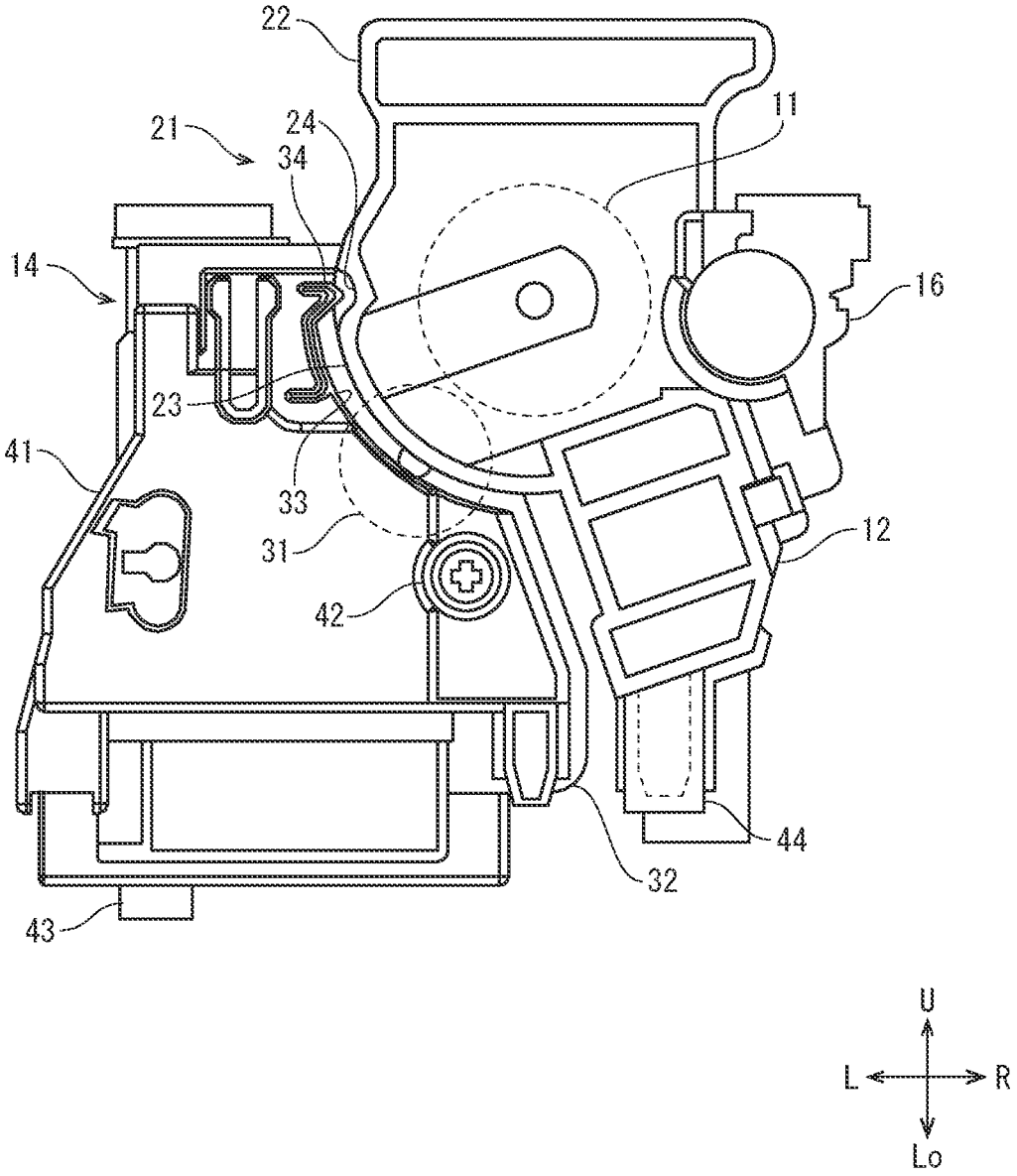
FIG. 7 is a front view showing the drum unit and the development unit after the drum unit is attached.

Next, an attachment operation of the drum unit 21 will be described. FIG. 6 is a front view showing the development unit 14 pushed away by the drum unit 21. FIG. 7 is a front view showing the drum unit 21 and the development unit 14 after the drum unit 21 is attached.

Before the drum unit 21 is attached, as shown in FIG. 5, the development unit 14 is positioned closer to the drum unit 21 than the predetermined position. When an operator lowers the drum unit 21 along the guide part 44, the curved surface parts 23 of the drum frame 22 come into contact with the opposing parts 33 of the development housing 32. When he lowers the drum unit 21 further, as shown in FIG. 6, the curved surface parts 23 push away the opposing parts 33 leftward against the biasing force of the biasing part 43. When the lower end portion of the drum frame 22 comes into contact with the bottom face of the guide part 44, the lowering of the drum unit 21 is stopped. Then, as shown in FIG. 7, the drum unit 21 is positioned. At this time, the fitting portions 24 of the drum frame 22 and the fitting portions 34 of the development housing 32 are fitted to each other, and the drum unit 21 is fixed.

On the other hand, when the drum unit 21 is detached, the operator draws out the drum unit 21 upward. At this time, the fitting portion 24 of the drum frame 22 pushes up the fitting portion 34 of the development housing 32 to turn the development housing 32 in the counterclockwise direction and to release the fitting of the fitting portion 24 and the fitting portion 34. Thereby, the operator can draw out the drum unit 21 without pushing back the development unit 14 leftward. Further, the fitting portion 24 is formed in a tapered shape toward the photosensitive drum 11 when viewed from the axial direction, and the fitting portion 34 is formed in a tapered shape toward the photosensitive drum 11, so that resistance generated when the drum unit 21 is drawn out is reduced as compared with a case where the fitting portion 24 and the fitting portion 34 are not formed in a tapered shaped.

According to the present embodiment described above, the printer 1 is configured such that the drum unit 21 is attachable and detachable in the attachment direction crossing to the shift direction of the development housing 32 and crossing to the axial direction of the development roller 31. Further, when the drum unit 21 is not attached, the development unit 14 is positioned closer to the drum unit 21 than the predetermined position of the development unit 14 when the drum unit 21 is attached, and when the drum unit 21 is attached, the drum frame 22 moving in the attachment direction pushes away the development housing 32 against the biasing force of the biasing part 43 to shift the development unit 14 to the predetermined position. Accordingly, it becomes possible to prevent the development unit 14 from interfering with the drum unit 21 when the drum unit 21 is attached.

Further, according to the printer 1 of the present embodiment, when the drum unit 21 is attached, since the curved surface parts 23 push away the opposing parts 33, the drum unit 21 can be attached with smooth operation.

Further, according to the printer 1 of the present embodiment, the curved surface part 23 and the opposing part 33 are provided with the fitting portions 24 and 34 which are fitted to each other when the development unit 14 is shifted to the predetermined position by attachment of the drum unit 21, so that the drum unit 21 can be easily positioned relative to the development unit 14.

Further, according to the printer 1 of the present embodiment, the curved surface part 23 is formed in an arc shape having a diameter larger than that of the photosensitive drum 11, so that the photosensitive drum 11 can be protected.

Further, according to the printer 1 of the present embodiment, the development housing 32 is supported in a turnable manner around the turning shaft 42, so that positioning accuracy can be enhanced as compared with a configuration in which the development housing 32 is supported in a linearly slidable manner.

The above embodiment may be modified as follows.

Although the above embodiment shows an example in which the drum unit 21 is attached from above, the present disclosure may be applied to a configuration in which the drum unit 21 is attached from the lateral side. For example, it contains the case where the turning shaft 42 is provided on the left side of the development roller 31, the biasing part 43 biases the development housing 32 upward, and the drum unit 21 is attached from the right side. According to this configuration, the same effects as those of the above-described embodiment can be obtained.

Although the above embodiment shows an example in which the supporting part 41 supports the development housing 32 in a turnable manner, the supporting part 41 may be configured to support the development housing 32 in a linearly slidable manner. For example, a rail on which the development housing 32 can be slid in the left-and-right direction may be provided on the supporting part 41, and the biasing part 43 which bias the development housing 32 rightward may be provided. According to this configuration, the same effects as those of the above-described embodiment can be obtained.

In the above embodiment, the fitting portion 24 of the curved surface part 23 is formed in a concave shape and the fitting portion 34 of the opposing part 33 is formed in a convex shape. However, the fitting portion 24 of the curved surface part 23 may be formed in a convex shape while the fitting portion 34 of the opposing part 33 may be concave shape.

In the above embodiment, the opposing part 33 is formed in an arc shape corresponding to the curved surface part 23, but the opposing part 33 may be formed in a shape not corresponding to the curved surface part 23, such as a straight shape.

In the above embodiment, the curved surface part 23 is formed in an arc shape, but the curved surface part 23 may be formed in a non-arc shape such as a polygon shape.

The above embodiment shows an example where the guide part 44 limits the attachment direction of the drum unit 21, however, the guide part 44 may not be provided, and the attachment direction of the drum unit 21 may be naturally limited due to interference with members disposed around the drum unit 21.

Further, the technique of the present disclosure is not limited to the above-described embodiment, and various changes, substitutions, and modifications may be made without departing from the spirit of the technical idea. Furthermore, if technological advances or other derived technologies can realize the technical ideas in other ways, they may be implemented using such methods. Accordingly, the claims cover all embodiments that may be contained within the scope of the technical concept.

The invention claimed is:

1. An image forming apparatus comprising:

a drum unit attachable to and detachable from a main housing, and including a photosensitive drum on which an electrostatic latent image is formed and a drum frame which supports the photosensitive drum;

a development unit including a development roller which carries a toner and a development housing which supports the development roller;

a supporting part which supports the development unit so as to be shiftable in directions close to and separate from the drum unit; and a biasing part provided in the main housing, and biasing the development housing toward the drum unit, wherein the drum unit is attachable to and detachable from the main housing in an attachment direction crossing to a shift direction of the development direction and crossing to an axial direction of the development roller, when the drum unit is not attached to the main housing, the development unit is biased by the biasing part and is positioned closer to the drum unit than a predetermined position of the development unit when the drum unit is attached, and when the drum unit is attached to the main housing, the drum frame pushes away the development housing against a biasing force of the biasing part to shift the development unit to the predetermined position.

2. The image forming apparatus according to claim 1, wherein the drum frame has curved surface parts protruding closer to the development unit than the photosensitive drum on outer sides of both end portions of the photosensitive drum in an axial direction of the photosensitive drum, the development housing has opposing parts corresponding to the curved surface parts, and when the drum unit is attached, the curved surface parts push away the opposing parts.

3. The image forming apparatus according to claim 2, wherein the curved surface parts and the opposing parts have fitting portions fitting to each other when the development housing is shifted to the predetermined position by an attachment of the drum unit.

4. The image forming apparatus according to claim 3, wherein the fitting portion of each of the curved surface parts is formed in a concave shape recessed toward the photosensitive drum, and the fitting portion of each of the opposing parts is formed in a convex shape protruding toward the photosensitive drum.

5. The image forming apparatus according to claim 3, further comprising a guide part which guides and positions the drum unit, wherein when the drum unit is guided and positioned, the fitting portions are fitted to each other.

6. The image forming apparatus according to claim 2, wherein the curved surface part is formed in an arc shape having a diameter larger than a diameter of the photosensitive drum.

7. The image forming apparatus according to claim 1, wherein the development housing is supported by the supporting part in a turnable manner in directions closer to and separate from the drum unit.

* * * * *